United States Patent [19]

Langen et al.

[11] Patent Number: 4,710,454

[45] Date of Patent: Dec. 1, 1987

[54] PHOTOGRAPHIC RECORDING MATERIAL AND A PROCESS FOR THE PRODUCTION OF PHOTOGRAPHIC IMAGES

[76] Inventors: Hans Langen; Heinz-Dieter Schütz; Ubbo Wernicke; Wolfgang Himmelmann; Günter Renner, all of Agfa-Gevaert Aktiengesellschaft, D-5090 Leverkusen, Fed. Rep. of Germany

[21] Appl. No.: 816,329

[22] Filed: Jan. 6, 1986

[30] Foreign Application Priority Data

Jan. 15, 1985 [DE] Fed. Rep. of Germany ..... 3501074

[51] Int. Cl.[4] ..... G03C 1/34; G03C 7/32

[52] U.S. Cl. ..... 430/546; 430/551

[58] Field of Search ..... 430/546, 545, 527, 530, 430/533, 551

[56] References Cited

U.S. PATENT DOCUMENTS

| | | | |
|---|---|---|---|
| 4,310,623 | 1/1982 | Watanabe et al. | 430/546 |
| 4,495,276 | 1/1985 | Takimoto et al. | 430/530 |
| 4,524,130 | 6/1985 | Iwasa et al. | 430/557 |

*Primary Examiner*—John L. Goodrow

[57] ABSTRACT

Photographic recording materials with improved processing stability are obtained by incorporating at least one phosphonic acid and at least one polyacrylic derivative.

8 Claims, 3 Drawing Figures

Figure 1:
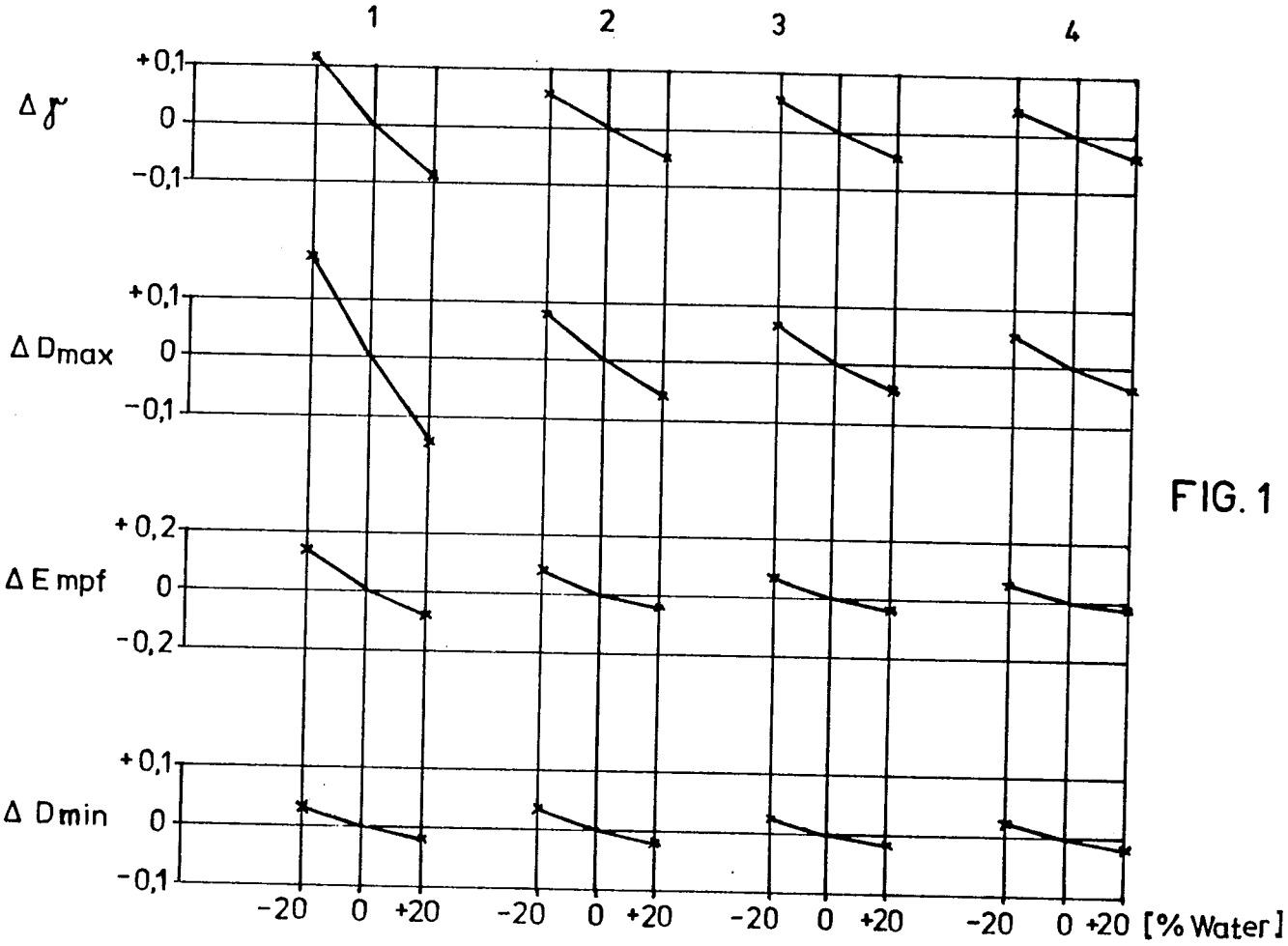

PHOTOGRAPHIC RECORDING MATERIAL AND A PROCESS FOR THE PRODUCTION OF PHOTOGRAPHIC IMAGES

This invention relates to a photographic recording material with at least one light-sensitive silver halide emulsion layer and a process for the production of photographic images. Photographic recording materials based on silver halide are developed after image-wise exposure and further processed. The used developers are regenerated to a great extent so that they can be used for a longer time. Although there are precise instructions for development, deviations from these defined desired values repeatedly, occur for different reasons. It is generally known that, in spite of precise developing instructions, the developing conditions often cannot be exactly maintained, either because the regenerating rate is not correct, the temperature fluctuates to a certain extent or particular substances built up or are spread in the developer.

These analytically fluctuating developers result in a variable sensitometry and thus in variable copying results, that is a colour drift or also a colour purity error can occur in the copy. These fluctuations particularly arise when the films to be processed include relatively slowly coupling colour components or particular colour components which include, in particular, cyan and yellow colour couplers.

The object of the invention is to provide photographic recording materials and a process for the production of photographic images which are stable against processing fluctuations.

A photographic recording material with at least one photosensitive silver halide emulsion layer, one coupler associated with this silver halide emulsion layer and optionally further layers has been found. According to the invention, the recording material contains a phosphonic acid and, in the coupler-containing layer, a polyacrylic acid derivative.

In a preferred embodiment, the polyacrylic acid derivative and phosphonic acid are in the same layer or in adjacent layers. Particularly preferred polyacrylic acid derivatives contain recurring units of the following formula (I):

$$-CH_2-\underset{\underset{A}{|}}{\underset{\underset{CO}{|}}{CR^1}}- \qquad (I)$$

wherein $R^1$ represents hydrogen or an alkyl radical having from 1 to 4 carbon atoms, A represents $NR^2R^3$ or $OR^2$, and $R^2$,$R^3$ are the same or different and represent hydrogen, or an optionally substituted alkyl radical, particularly having from 1 to 10 carbon atoms.

When A represents $OR^2$, $R^2$ in a preferred embodiment is an alkylene oxide radical, particularly of the formula $$-[OR^4]_m OR^5,$$

wherein:

$R^4$ represents a bivalent radical particularly having from 2 to 3 carbon atoms, $R^5$ represents H or alkyl having from 1 to 4 carbon atoms, and m represents from 1 to 4.

In a preferred embodiment, the polyacrylic derivative is a homo- or copolymer, soluble in organic solvents and insoluble in water, of an ester of unsubstituted or substituted acrylic acid. Particularly preferred are polymers with recurring units of the formula (Ia):

$$-[CH_2-\underset{\underset{COOR^2}{|}}{CR^1}]- \qquad (Ia)$$

wherein $R^1$ and $R^2$ are as defined above.

Polyacrylic acid derivatives of the formula (I) can be produced by polymerisation of suitable monomers. Suitable monomers are particularly acrylic acid esters and other derivatives of acrylic acid. Different monomers of the formula (I) can be used, so that the obtained polyacrylic acid derivatives is a copolymer. In addition, further comonomers which are not included in the formula (I) can be copolymerised at the same time. Suitable monomers which give recurring units of the formula (I) are given in the following Table 1:

Table 1

1.1 Acrylic acid ethyl ester
1.2 Acrylic acid butyl ester
1.3 Acrylic acid-2-ethyl-hexyl ester
1.4 Acrylic acid methoxyethyl ester
1.5 Acrylic acid ethoxyethyl ester
1.6 $C_4H_9-O-CH_2-CH_2-O-CH_2-CH_2-O-CO-CH=CH_2$
$C_2H_5-O-CH_2-CH_2-O-CH_2-CH_2-O-CO-CH=CH_2$ In a preferred embodiment, the monomers given in Table 1 are polymerized together with the following monomers, from 1 to 5% of each of the following monomers being contained in the polymerization mixture: acrylic acid, methacrylic acid, methacrylic acid methyl ester, fumaric acid butyl ester, acrylonitrile, acrylamide, vinylisobutyl ether and styrene.

Particularly preferred phosphonic acids correspond to the following formula (II):

$$R_{10}R_{11}N-B-PO_3M_2 \qquad (II)$$

wherein

M represents a hydrogen atom or a cation which confers water-solubility, for example an alkali metal atom, for example a sodium or potassium atom, an ammonium, pyridinium, triethanol-ammonium or triethyl-ammonium group, B represents an optionally substituted linking group, particularly $(CH_2)_n$, whereby n is an integer, preferably 1 or 2, or a substituted alkylene group, $R_{10}$,$R_{11}$ are the same or different and represent hydrogen, an optionally substituted carbamoyl group, an optionally substituted alkyl group preferably having from 1 to 4 carbon atoms, for example a methyl, ethyl propyl, isopropyl or butyl group, an optionally substituted aryl group, for example a phenyl, o-, m- and p-tolyl-, o- and p-carboxyphenyl group as well as the water-soluble salts thereof, such as sodium and potassium salts, an optionally substituted aralkyl group preferably having from 7 to 9 carbon atoms, for example a benzyl-β-phenethyl or o-acetamidobenzyl group, an optionally substituted alicyclic group preferably having 5 or 6 carbon atoms, for example, a cyclohexyl or cyclopentyl group, or an optionally substituted heterocyclic radical, for example a heterocyclylalkyl group, for example a morpholine, pyrrolidylalkyl, benzthiazolylmethyl or tetrahydroquinolylmethyl group or together the ring members for forming a ring system with preferably 5 or 6 ring members.

$R_{10}$ and $R_{11}$ can be further substituted, particularly when they represent an alkyl group, by at least one hydroxyl, $—PO_3M_2—$, $—CH_2PO_3M_2—$ or $$—\overset{|}{N}(CH_2)_nPO_3M_2$$

group, M being as defined above.

Further preferred phosphonic acids correspond to the following formula (III):

$$R_{10}R_{11}\overset{X}{\overset{|}{C}}PO_3M_2 \qquad \text{(III)}$$

wherein

X represents $PO_3M_2$ or COOM and $R_{10}$,$R_{11}$ and M are as defined in formula (II).

The phosphonic acids to be used according to the invention are to be understood as including those which, in place of a $PO_3M_2$ group, have a condensed phosphonic acid grouping, for example, of the following structure:

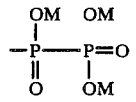

Particularly preferred phosphonic acids of the formula (II) are given in the following Table 2:

TABLE 2

| | |
|---|---|
| 2.1 | 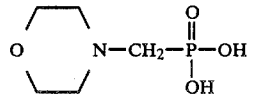 |
| 2.2 | $(H_2O_3P—CH_2)_2N—CH_2—CH_2—N(CH_2—PO_3H_2)—CH_2—CH_2—N(CH_2—PO_3H_2)_2$ |
| 2.3 | 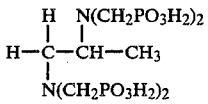 |
| 2.4 | 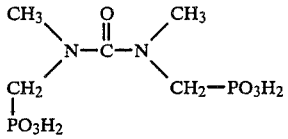 |
| 2.5 | 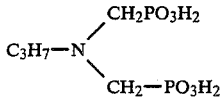 |
| 2.6 | 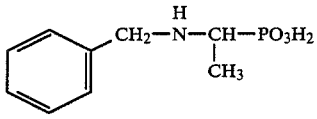 |
| 2.7 | 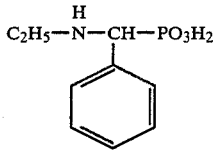 |
| 2.8 | $(H_2O_3P—CH_2)_2N—CH_2—CH_2—N(CH_2—PO_3H_2)_2$ |
| 2.9 | 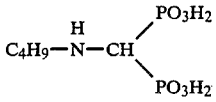 |
| 2.10 | 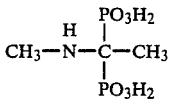 |

TABLE 2-continued

| | |
|---|---|
| 2.11 | $H_2O_3P-CH_2-\overset{H}{N}-CO-\overset{H}{N}-CH_2-PO_3H_2$ |
| 2.12 | $HOOC-CH_2-NH-CH_2-PO_3H_2$ |
| 2.13 | $(CH_3)_2N-CH_2-CH_2-C(PO_3H_2)_2-OH$ |

Preferred compounds of the formula (III) are given in the following table:

TABLE 3

| | |
|---|---|
| 3.1 | $HO-P(=O)(OH)-C(CH_3)(OH)-P(=O)(OH)-OH$ |
| 3.2 | $HOO-CH_2-C(COOH)(PO_3H_2)-CH_2-CH_2-COOH$ |
| 3.3 | $C_3H_7-C(PO_3H_2)_2-OH$ |
| 3.4 | $(CH_3)_2CH-C(PO_3H_2)_2-OH$ |

The use of polyacrylates in photographic recording materials is known; for example, the use of oligomeric polyalkyl acrylates as oil formers, particularly for preventing crystallisation tendencies, is described in GDR Pat. No. 144 129, and the use of high molecular weight polyalkyl acrylates as oil formers for improving the sensitometry (reduction in fog, increase in sensitivity and D-max) is described in DE-AS No. 1 954 467.

The photographic use of alkyl-phosphonic acids is also already known. In addition to use in developers, the use, for example, as complex formers for tin as emulsion additive (U.S. Pat. No. 3,951,665), as dispersing agent for colour coupler emulsifiers (GDR No. 160 619, GDR No. 160 620, GDR No. 160 621) and as layer additive for preventing marks caused by metal dusts (DE-PS No. 1 289 421) is described. However, the combined use for improving the processing stability is not known.

The phosphonic acids and polyalkyl acrylates to be used according to the invention are preferably used in the following quantities per $m^2$:

(a) Phosphonic acids: from 0.05 g to 2.0 g, particularly 0.1 g to 0.8 g, (b) Polyalkyl acrylates: from 0.05 g to 2.0 g, particularly from 0.1 g to 1.0 g.

The recording material according to the invention preferably contains on a support in each case at least one blue-, green- and red-sensitive layer, which can be separated into partial layers of varying sensitivity. At least one blue-sensitive layer is preferably positioned above the green- and red-sensitive layers and is separated from these by a yellow filter layer. In addition to the photosensitive layers, further protective and intermediate layers can be used.

In a particularly preferred embodiment, the following layers are arranged on a support in the given order:

1. at least two red-sensitive partial layers,
2. at least two green-sensitive partial layers,
3. one yellow filter layer,
4. at least one blue-sensitive layer, in which the sensitivity of partial layers of the same spectral sensitivity is higher, the further it is from the layer support. It is moreover possible to combine the low-sensitive red- and green-sensitive partial layers as well as the high-sensitive red- and green-sensitive partial layers in a similar layer formulation.

Colour couplers are associated with the photosensitive silver halide emulsion layers, which couplers react with colour developer oxidation products to form a non-diffusing dye. The colour couplers are suitably incorporated in a non-diffusing manner in the photosensitive layer itself or in close proximity thereto. Thus, the red-sensitive layer can, for example, contain a non-diffusing colour coupler for producing the cyan partial colour image, generally a coupler of the phenol or α-naphthol type. The green-sensitive layer can, for example, contain at least one non-diffusing colour coupler for producing the magenta partial colour image, colour couplers of the 5-pyrazolone type normally being used. The blue-sensitive layer can, for example, contain at least one non-diffusing colour coupler for producing the yellow partial colour image, generally a colour coupler with an open-chain ketomethylene grouping. The colour couplers can be, for example, 6-, 4- and 2-equivalent couplers. Suitable couplers are known for example, from the publications "Farbkuppler" by W. Pelz in "Mitteilungen aus den Forschungslaboratorien der Agfa, Leverkuse/München", vol III, p. 111 (1961), K. Venkataraman in "The chemistry of Synthetic Dyes", vol 4, 341 to 387, Academic Press (1971) and T. H. James, "The Theory of the Photographic Process", 4th Ed., P. 353 to 362, as well as in the Journal Research Disclosure No. 17643 of December 1978, section VII, published by Industrial Opportunities Ltd., Homewell Havant, Hampshire, PO9 1EF, Great Britain.

The recording material can moreover contain DIR compounds and white couplers which do not produce a dye when reacting with coupler developer oxidation products. The inhibitors which can be released from the DIR compounds can be released directly or via non-restricting intermediate compounds. Reference is made to GB No. 953 454, U.S. Pat. No. 3,632,345, U.S. Pat. No. 4,248,962 and GB No. 2 072 363.

The photosensitive silver halide emulsions used can contain chloride, bromide and iodide or mixtures thereof as halide. In a preferred embodiment, the halide proportion of at least one layer is from 0 to 12 mol% of AgI, from 0 to 50 mol% of AgCl and from 50 to 100% of AgBr, the sum of these proportions being 100%. In a preferred embodiment, there are predominantly compact crystals, which, for example, are cubic or octohedric or of transitional form. They can be characterised in that they predominantly have a thickness of greater than 0.2 μm. The average ratio of diameter to thickness is preferably less than 8:1, the diameter of a grain being defined as the diameter of a circle with a circular area corresponding to the projected surface of the grain. In another preferred embodiment, all or individual emulsions can also have predominantly plate-like silver halide crystals, in which the ratio of diameter to thickness is greater than 8:1.

The emulsions can be chemically sensitized. The usualy sensitizing agents are suitable for the chemical sensitization of the silver halide grains. Particularly preferred are sulphur-containing compounds, for example, allyl isothiocyanate, allyl thiourea and thiosulphates. Reducing agents and noble metals or nobel metal compounds such as gold, platinium, palladium, iridium, ruthenium or rhodium are also suitable as chemical sensitizers, see R. Koslowsky, Z. Wiss. Phot. 46, 65–72 (1951). It is moreover possible to sensitize the emulsions with polyalkylene oxide derivatives. Reference is again made to the above Research Disclosure No. 17643, section III.

The emulsions can be optically sensitized in known manner, for example with the usual polymethine dyes, such as neutrocyanines, basic or acidic carbocyanines, rhodacyanines, hemicyanines, styryl dyes, oxonoles and the like, see F. M. Hamer in "The Cyanine Dyes and Related Compounds" (1964), Ullmanns Enzyklopädie der technischen Chemie, 4th edition volume 18, pages 431 et seq and the above Research Disclosure No. 17643, section IV.

The generally used antifogging agents and stabilizers can be used. Mercapto compounds, for example, mercaptoazoles, acetylene derivatives, organic reducing agents and azain denes, preferably tetra or penta-azaindenes, particularly those which are substituted by hydroxyl or amino groups, are particularly suitable as stabilizers. Such compounds are given, for example, in the article by Birr, Z. Wiss. Phot. 47, (1952), p. 2–58 and in the above Research Disclosure No. 17643, section IV.

The constituents of the photographic material can be incorporated according to the usual known methods. In the case of water- or alkali-soluble compounds, they can be added in the form of aqueous solutions, optionally with addition of water-miscible organic solvents such as ethanol, acetone or dimethyl formamide. In the case of water- or alkali-insoluble compounds, they can be incorporated in the recording materials in dispersed form in known manner. For example, a solution of these compounds can be directly mixed into a low boiling organic solvent with the silver halide emulsion, or firstly with an aqueous gelation solution, and thereupon the organic solvent can be removed. The dispersion of each compound obtained in this manner can then be mixed with the silver halide emulsion. So-called oil formers are optionally additionally used, generally high-boilng organic compounds which include the compounds to be dispersed in the form of oily droplets. Such oilformers are phosphoric acid esters, such as triphenylphosphate and tricresylphosphate, phthalic acid esters, such as dibutyl phthalate, amides such as dibutylaurylamide, ethers such as ethyleneglycolmonobenzylether, ketones such as 2-methylcyclohexanone, esters of aliphatic dibasic acids such as ethylhexyl adipate, esters of aliphatic monobasic acids such as oleic acid esters, N-alkylpyrolidones such as N-octylpyrrolidone, polyether alcohols etc.

Furthermore, polymeric oilformers such as polycondensation products of adipic acid and hexandiole or phthalic acid and hexan diole are suitable.

It is also possible with advantage, to use oil formers containing carboxyl groups, for example the succinic acid derivatives containing at least one carboxyl group according to U.S. Pat. Nos. 3,689,271; 3,764,336 and 3,765,897.

To produce the color photographic recording material according to the invention the compounds which are to be emulsified together with at least one compound corresponding to formula (I) and optionally an oil former in question, are preferably initially dissolved in an organic auxiliary solvent, such as ethanol, ethyl acetate, diethyl carbonate, acetone or a mixture thereof. One example of a mixture which has proved to be favourable is a mixture of 80 parts of ethyl acetate and 20 parts of ethanol or a mixture of 80 parts of diethyl carbonate and 20 parts of ethanol.

It is also possible to incorporate constituents of the photographic material, for example, coupler and UV-absorbers in the form of charged latices, see DE-OS No. 2 541 274 and EP-A No. 14 921. Moreover, the components can also be fixed as polymers in the material, see, for example, DE-OS No. 2 044 992, U.S. Pat. No. 3,370,952 and U.S. Pat. No. 4,080,211.

For the materials according to the invention, the usual layer supports can be used, for example those based on cellulose esters, for example cellulose acetate, and on polyesters. Paper supports which can be optionally coated, for example, with polyolefins, particularly with polyethylene or polypropylene, are also suitable. Reference is made in this respect to the above Research Disclosure No. 17643, section XVII.

The usual hydrophilic film-forming agents are suitable as protective colloid or binding agent for the layers of recording material, for example, proteins, particularly gelatins, see Research Disclosure 17643, section IX.

The layers of photographic material can be hardened in the usual manner, for example with hardeners of the epoxide type, of the heterocyclic ethylene-imine and of the acryloyl type. Moreover, it is also possible to harden the layers according to the process of German Offenlegungsschrift No. 2 218 009, to achieve colour-photographic materials which are suitable for high temperature processing. It is moreover possible to harden the photographic layers or the colour-photographic multilayer materials with hardeners of the diazine, triazine or 1,2-dihydroquinoline series or with hardeners of the vinyl sulphone type. Further suitable hardening agents are known from the German Offenlegungsschriften Nos. 2 439 551, 2 255 230, 2 317 672 and from the above Research Disclosure 17643, section XI.

The usual conditions of colour developing can be maintained in developing. Developing generally takes place with a pH of above 8.

Developing can be carried in the presence of pH buffers, developing inhibitors, antifogging agents, complex formers for water-softening, preservatives, developing accelerators, competitive couplers, masking agents, auxiliary developer compounds and viscosity modifiers; reference is made to the Research Disclosure 17 544 of December 1978, published by Industrial Opportunities Ltd., Homewell Havant, Hampshire, Great Britain, section XXI and Ullmanns Enzyklopädie der technischen Chemie, 4th edition, volume 18, 1979, particularly pages 451, 452 and 463 to 465. A detailed description of suitable developer compositions and processing processes is given by Grant Haist, Modern Photographic Processing, John Wiley and Sons, 1973, volume 1 and 2.

Suitable colour developer substances for the material according to the invention are particularly those of the p-phenylene diamine type, for example, 4-amino-N,N-diethylaniline hydrochloride; 4-amino-3-methyl-N-ethyl-N-β-(methane sulphonamido)-ethyl aniline sulphate hydrate; 4-amino-3-methyl-N-ethyl-N-β-hydroxyethyl aniline sulphate; 4-amino-N-ethyl-N-(2-methoxyethyl)-m-toluidine-di-p-toluene sulphonic acid and N-ethyl-N-β-hydroxyethyl-p-phenylene diamine.

After colour developing, the material is normally bleached and fixed. Bleaching and fixing can be carried out separately or together. The usual compounds can be used as bleaching agent, for example $Fe^{3+}$ salts and $Fe^{3+}$ complex salts such as ferricyanides, dichromates, water-soluble cobalt complexes etc. Particularly preferred are iron-III complexes of aminopolycarboxylic acids, particularly, for example, ethylene diamine tetraacetic acid, nitrilotriacetic acid, iminodiacetic acid, N-hydroxyethyl ethylene diamine triacetic acid, alkyliminodicarboxylic acids and of corresponding phosphonic acids. Persulphates are also suitable as bleaching agent.

EXAMPLES

The substances used in the following examples have the following formulae:

Gb-1

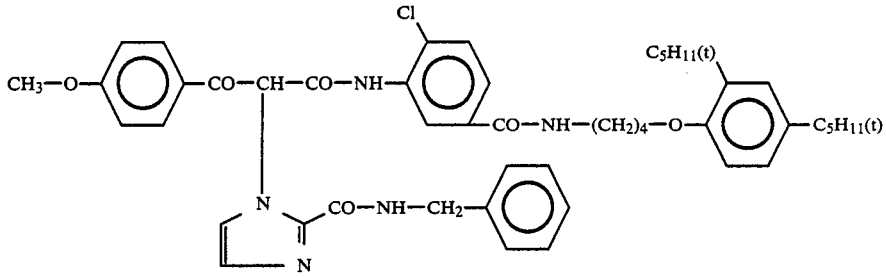

Gb-2

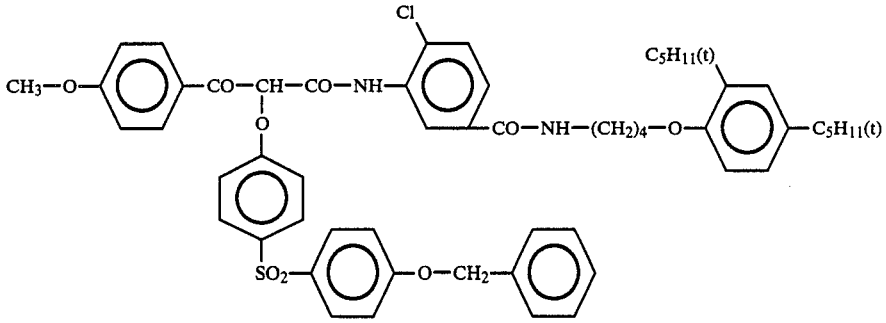

Gb-3

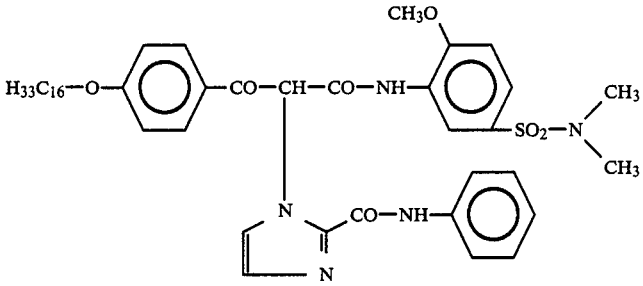

Production of the dispersion A given in the examples: 100 g of the given coupler are dissolved together with 50 g of the compound 1.1 as well as 400 ml of ethyl acetate at 50° C. and stirred with a high-speed mixer in 1 kg of a 5% gelatin solution, likewise heated to 50° C., which has been treated with 10 g of triisopropyl naphthalene sulphonate, and then homogenized under high pressure.

EXAMPLE 1, variant 1

The following high-sensitive colour negative materials are produced by applying the following layers to a conventional layer support:

Layer 1: anti-halation layer with colloidal silver, gelatin and an di-octylhydroquinone Layer 2: intermediate layer Layer 3: red-sensitive, low-sensitive silver bromideiodide emulsion layer wth a conventional cyan coupler, a DIR coupler and a red masking coupler.

Layer 4: red-sensitive, high-sensitive silver bromideiodide emulsion layer (10 mol % of iodide) and the cyan coupler given in layer 3

Layer 5: intermediate layer with gelatin and a dioctylhydroquinone

Layer 6: green-sensitive, low-sensitive silver bromideiodide layer (5 mol % of silver iodide) with a magenta coupler, a yellow masking coupler and a DIR coupler Layer 7: green-sensitive, high-sensitive silver bromideiodide layer (9 mol % of iodide) with the magenta and masking couplers given in layer 6

Layer 8: intermediate layer with gelatin and an dioctylhydroquinone

Layer 9: yellow filter layer with colloidal silver

Layer 10: blue-sensitive, low-sensitive silver bromideiodide emulsion layer (6 mol % of iodide) and 1.05 g per $m^2$ of the coupler Gb-1 introduced in the form of dispersion A. Silver application: corresponding to 1.0 g of silver nitrate per $m^2$ Layer 11: blue-sensitive, high-sensitive silver bromideiodide layer (8.5 mol % of silver iodide) and 0.26 per $m^2$ of the colour coupler Gb-1 introduced as dispersion A. Silver application: corresponding to 0.8 g of silver nitrate per $m^2$.

Layer 12: UV-absorbing layer

Layer 13: hardening-protective layer with gelatin and a carbamoyl pyridinium salt as hardening agent.

The given layers contain further conventional components in addition to the given constituents.

The variants 2 to 9 of Example 1 are correspondingly produced, the composition of dispersion A in layer 10 (low blue-sensitive layer) being varied according to the following table.

| Variant | Dispersion A | P | Oil former | Gradation yellow D-1 | Gradation yellow D-2 | Gradation yellow Δ | Maximum yellow density D-1 | Maximum yellow density D-2 | Maximum yellow density Δ |
|---|---|---|---|---|---|---|---|---|---|
| 1 Comparison | — | | 1.1 | 0.59 | 0.47 | 0.12 | 3.28 | 2.88 | 0.40 |
| 2 Comparison | — | | TCP | 0.59 | 0.39 | 0.20 | 3.26 | 2.45 | 0.81 |
| 3 Invention | 3.1 | | 1.1 | 0.60 | 0.60 | 0 | 3.30 | 3.05 | 0.25 |
| 4 Comparison | 3.1 | | TCP | 0.60 | 0.46 | 0.16 | 2.23 | 2.66 | 0.57 |
| 5 Invention | | | 1.1 | 0.62 | 0.53 | 0.09 | 3.26 | 2.96 | 0.30 |
| 6 Invention | 2.2 | | 1.1 | 0.59 | 0.55 | 0.04 | 3.29 | 3.03 | 0.26 |
| 7 Invention | 2.3 | | 1.1 | 0.59 | 0.52 | 0.07 | 3.29 | 3.01 | 0.28 |
| 8 Invention | 2.4 | | 1.1 | 0.61 | 0.56 | 0.05 | 3.27 | 3.00 | 0.27 |
| 9 Invention | 3.2 | | 1.1 | 0.64 | 0.63 | 0.01 | 3.14 | 2.96 | 0.18 |

P = Phosphonic acid
TCP = tricresyl phosphate
D-1 = developer 1
D-2 = developer 2
Δ = gradation difference Two samples of each of the above-described materials are then exposed behind a graduated grey wedge, and one sample is developed in the developer D-1 described below and the other sample is developed in the modified developer D-2 as an example of an untypical variant of developer D-1, in each case for 3.25 minutes at 38° C. Further processing takes place according to the method described by Ernest CH. Gehret, British Journal of Photography 1974, p. 597.

Developer D-1

1.2 g of ethylene diamine tetraacetic acid
1.5 g of potassium bromide
36.3 g of potash
1.6 g of sodium bicarbonate
2.0 g of hydroxylamine sulphate
1.9 g of sodium sulphite
2.1 g of potassium metabi sulphate
4.75 g of 4-amino-3-methyl-N-ethyl-N(β-hydroxyethyl)-analine sulphate made up to 1 l with water Developer D-2

The developer has the same composition as developer D-1, except that there is no ethylene diamine tetraacetic acid, and in place of 36.3 g of potash, only 20 g of potash. It ca be clearly seen in the table that by using the combination according to the invention, the gb-$D_{max}$ and gradation differences in the different developers are so substantially reduced that practically no variable copying results are obtained.

EXAMPLE 2

Variant 1

The procedure is as in Example 1, variant 2, except that in place of Gb-1, the yellow coupler Gb-2 is used.

Variant 2

A layer formation is produced as in variant 1, except that in both blue-sensitive layers (layers 10 and 11) an additional 0.05 g of the compound 2.4 is added. Compound 1.1 is used as oil former.

Variant 3

The procedure is as in variant 2, but using in each case 0.1 g of the compound 2.4.

Variant 4

The procedure is as in variant 2, but using in each case 0.2 g of the compound 2.4.

Three samples, in each case of the material are now exposed behind a graduated grey wedge and in each case one sample is developed (a) in Developer 1/Example 1

(b) in the same developer with 20% lower water content (c) in the same developer with 20% high water content and further processes as described in Example 1. The displacement of gradation, maximum density, sensitivity and $D_{min}$ is shown in FIG. 1. It can be clearly seen that by means of the combinations 2 to 4 according to the invention, the deviation in the sensitometric data with the developers (b) and (c) is much lower than in comparative Example 1.

EXAMPLE 3

Variant 1

A material is produced as in Example 1, Variant 2, except that Gb-3 is used as yellow coupler.

Variant 2

A material is produced as in Variant 1, but the compound 1.2 is used as oil former in place of TCP and in the high and low-sensitive blue-sensitized casting, 0.05 g of the compound 3.1 is additionally added in each case.

Figure 2:
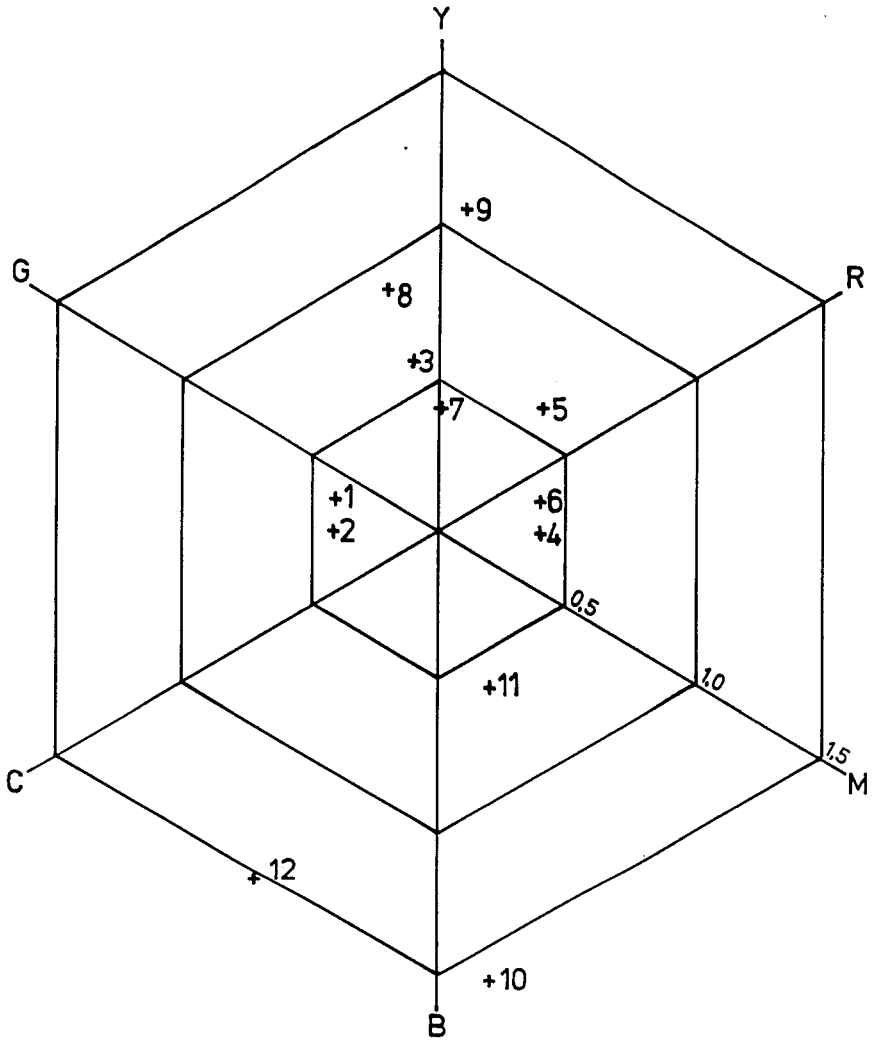
Figure 3:
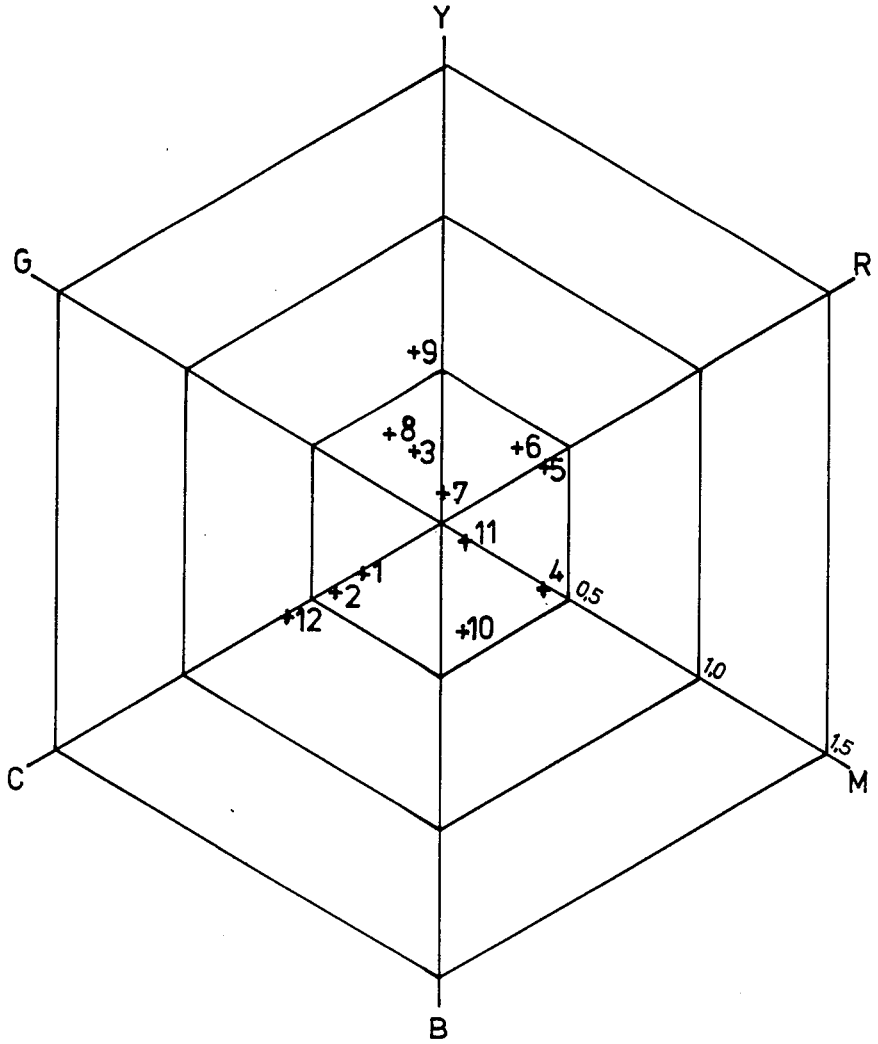

The two materials are exposed behind a graduated grey wedge and are processed on 12 days (samples numbered 1 to 12) according to the processing instructions described in the Process C 42 Manual, January 1984, Eastman Kodak Company, with a spacing of 3 days in each case, in a developing machine of the Kodacolor Dual-Strand Film Processor, Model 2, type. The differences in density of the image of a neutral object of average brightness $D_{gb\text{-}pp}$ and $D_{bg\text{-}pp}$ with $D_{pp}=1.2$ are entered into a trilinear diagram corresponding to the German standard DIN 4522 (FIGS. 2 and 3). It can be clearly seen in the diagrams that the density variations obtained on the 12 experiment days are much lower in the combination (FIG. 3) according to the invention than in the case of the comparative material (FIG. 2). The closer together the individual samples are positioned in the co-ordinate central point, the better the values obtained.

We claim:

1. A photographic recording material with at least one photosensitive silver halide emulsion layer, a coupler associated with the silver halide emulsion layer and optionally further layers, characterised in that it contains at least one phosphonic acid of the following structures $$R_{10}R_{11}N-B-PO_3M_2$$

or $$R_{10}R_{11}\overset{\overset{X}{|}}{C}-PO_3M_2$$

wherein

X represents $PO_3M_2$ or $CO_2M$

M represents a hydrogen atom or a cation which confers water-solubility,

B represents $(CH_2)_n$, whereby n is an integer or a substituted alkylene group, $R_{10}$,$R_{11}$ are the same or different and represent hydrogen, an optionally substituted carbamoyl group, an optionally substituted alkyl group, an optionally substituted aryl group, an optionally substituted aralkyl group preferably having from 7 to 9 carbon atoms, an optionally substituted alicyclic group or an optionally substituted heterocyclic radical or together the ring members for forming a ring system with 5 or 6 ring members;

and, in the coupler-containing layer, at least one polyacrylic acid derivative.

2. A photographic recording material according to claim 1, characterised in that the phosphonic acid and the polyacrylic acid derivative are present in the same layer or in adjacent layers.

3. A photographic recording material according to claim 1, characterised in that the polyacrylic acid derivative and the phosphonic acid are present in an overlying blue-sensitive layer.

4. A photographic recording material according to claim 1, characterised in that the polyacrylic acid derivative has recurring units of the following structure:

$$-CH_2-\underset{\underset{A}{|}}{\overset{\overset{CO}{|}}{CR^1}}-$$

wherein $R^1$ represents hydrogen or alkyl having from 1 to 4 carbon atoms,

A represents $NR^2R^3$ or $OR^2$, and $R^2$,$R^3$ are the same or different, and represent hydrogen or optionally substituted alkyl.

5. A photographic recording material according to claim 1, characterised in that the polyacrylic acid derivative is contained in a quantity of from 0.05 to 2.0 g per $m^2$ and the phosphonic acid in a quantity of from 0.05 to 2.0 g per $m^2$.

6. A photographic recording material according to claim 1, characterised in that the polyacrylic acid derivative is an ester of optionally substituted acrylic acid, which is soluble in organic solvents and insoluble in water.

7. A process for the production of photographic images by developing a silver halide-containing recording material in a photographic colour developer, characterised in that a recording material according to claim 1 is used.

8. A process according to claim 7, characterised in that the developer has a pH of from 9.5 to 10.5.

* * * * *